US007296629B2

(12) United States Patent
Bartlett

(10) Patent No.: US 7,296,629 B2
(45) Date of Patent: Nov. 20, 2007

(54) SUBSEA COMPLETION SYSTEM, AND METHODS OF USING SAME

(75) Inventor: Christopher D. Bartlett, Spring, TX (US)

(73) Assignee: FMC Technologies, Inc., Houston, TX (US)

( * ) Notice: Subject to any disclaimer, the term of this patent is extended or adjusted under 35 U.S.C. 154(b) by 18 days.

(21) Appl. No.: 10/965,135

(22) Filed: Oct. 14, 2004

(65) Prior Publication Data

US 2005/0098321 A1 May 12, 2005

Related U.S. Application Data

(60) Provisional application No. 60/512,713, filed on Oct. 20, 2003.

(51) Int. Cl.
*E21B 29/12* (2006.01)

(52) U.S. Cl. ..... 166/348; 166/339; 166/344; 166/89.2

(58) Field of Classification Search ..... 166/348, 166/338, 339, 341–344, 360, 368, 89.2
See application file for complete search history.

(56) References Cited

U.S. PATENT DOCUMENTS 4,651,831 A * 3/1987 Baugh ..... 166/344
5,289,882 A * 3/1994 Moore ..... 166/379
5,372,199 A * 12/1994 Cegielski et al. ..... 166/368
5,503,230 A 4/1996 Osborne et al. ..... 166/344
5,544,707 A 8/1996 Hopper et al. ..... 166/382
5,701,953 A * 12/1997 Stecker et al. ..... 166/75.13
5,941,310 A 8/1999 Cunningham et al. ..... 166/345
6,076,605 A 6/2000 Lilley et al. ..... 166/368
6,142,236 A 11/2000 Brammer et al. ..... 166/358
6,378,613 B1 4/2002 Kent et al. ..... 166/368
6,388,577 B1 * 5/2002 Carstensen ..... 340/854.3
6,474,417 B1 * 11/2002 Blair et al. ..... 166/368
6,488,083 B2 * 12/2002 Bartlett et al. ..... 166/87.1

(Continued)

FOREIGN PATENT DOCUMENTS

GB 2 321 658 A 12/1997

(Continued)

OTHER PUBLICATIONS

PCT Search Report and Written Opinion, PCT/US04/34021, Oct. 27, 2006.

(Continued)

*Primary Examiner*—Thomas A Beach
(74) *Attorney, Agent, or Firm*—Williams, Morgan & Amerson, P.C.

(57) ABSTRACT

A subsea production system that is adapted to be coupled to a subsea wellhead and includes a tubing hanger adapted to be positioned in the wellhead. The tubing hanger has a flow opening extending therethrough and has at least one eccentrically located opening extending through the tubing hanger. In some cases, the tubing hanger is adapted to be not precisely oriented with respect to a fixed reference point when positioned in the wellhead. The system also includes a production tree adapted to be operatively coupled to the tubing hanger, wherein the production tree is oriented relative to the tubing hanger. In other embodiments, the tubing hanger is riot oriented with respect to the wellhead or other fixed reference point.

21 Claims, 7 Drawing Sheets

U.S. PATENT DOCUMENTS

| | | | | |
|---|---|---|---|---|
| 6,494,257 | B2 | 12/2002 | Bartlett et al. | 166/86.2 |
| 6,520,262 | B2 | 2/2003 | Barnett et al. | 166/367 |
| 6,547,008 | B1 | 4/2003 | Hopper et al. | 166/348 |
| 6,595,293 | B2 | 7/2003 | Carter | 166/345 |
| 6,612,368 | B2 | 9/2003 | Kent et al. | 166/75.13 |
| 6,615,923 | B1 * | 9/2003 | Lay et al. | 166/368 |
| 6,655,455 | B2 | 12/2003 | Bartlett et al. | 166/86.2 |
| 6,668,943 | B1 | 12/2003 | Maus et al. | 175/5 |
| 6,675,900 | B2 | 1/2004 | Baskett et al. | 166/379 |
| 6,712,560 | B1 | 3/2004 | Cottrell | 405/224.4 |
| 6,715,554 | B1 | 4/2004 | Cunningham et al. | 166/348 |
| 6,715,555 | B2 | 4/2004 | Milberger et al. | 166/368 |
| 6,719,059 | B2 | 4/2004 | Dezen et al. | 166/368 |
| 6,742,594 | B2 | 6/2004 | Langford et al. | 166/350 |
| 6,755,254 | B2 | 6/2004 | DeBerry | 166/368 |
| 6,769,489 | B2 * | 8/2004 | Dallas | 166/386 |
| 6,776,230 | B2 * | 8/2004 | Collie et al. | 166/97.1 |
| 7,069,988 | B2 | 7/2006 | Bartlett et al. | 166/86.2 |
| 7,096,937 | B2 | 8/2006 | Bartlett et al. | 166/86.2 |
| 7,150,325 | B2 * | 12/2006 | Ireland et al. | 166/366 |
| 2002/0185279 | A1 * | 12/2002 | Blair et al. | 166/335 |
| 2003/0155126 | A1 * | 8/2003 | Radi et al. | 166/350 |
| 2004/0007362 | A1 * | 1/2004 | Rodgers et al. | 166/344 |
| 2004/0168795 | A1 * | 9/2004 | Owens | 166/75.13 |
| 2006/0231266 | A1 * | 10/2006 | Rodrigues et al. | 166/365 |

FOREIGN PATENT DOCUMENTS

| | | | |
|---|---|---|---|
| GB | 2346630 | * | 8/2000 |

OTHER PUBLICATIONS

Omsberg, "Surface Lateral Tree for North Sea Platform," SPE 26773, Oct. 1993.

Tait, "The Horizontal Xmas Tree, The Story So Far," 1993.

Lorimer, "Horizontal Subsea Trees for the Shasta Development: An Operators Perspective," OTC 8252, 1996.

Crine, Functional Specification, "Supply of Subsea Completion Systems & Installation Equipment Horizontal Xmas Trees," Apr. 1996.

Vick et al., "A Static Slickline-Retrievable Wellhead Plug System for Use with Horizontal Trees in Offshore Systems," SPE 50591, 1996.

Cohen et al., "Development of a Gas Handling Hydraulic Submersible Pump and Planning a Field Trial, Captain Field," OTC 8511, 1997.

ABB Vetco Brochure, "At last, wellhead seal integrity in horizontal trees," 1995.

ABB Vetco Brohcure, "Horizontal Tree Demonstration Report," 1995.

* cited by examiner

SUBSEA COMPLETION SYSTEM, AND METHODS OF USING SAME

RELATED CASES

The present application claims priority from provisional U.S. application No. 60/512,713 filed on Oct. 20, 2003, which is hereby incorporated by reference in its entirety.

BACKGROUND OF THE INVENTION

1. Field of the Invention

The present invention is generally directed to subsea completion systems for oil and gas wells, and, more particularly, to, in one embodiment, a subsea system comprising a top flow Christmas tree.

2. Description of the Related Art

A typical subsea well comprises a high pressure wellhead housing which supports one or more casing hangers located at the upper ends of strings of casing that extend into the well. The system further comprises a tubing hanger that supports a string of production tubing through which the oil and/or gas products will eventually be produced. Such a system further comprises a production tree or Christmas tree, e.g., a horizontal or vertical Christmas tree, that contains one or more production bores and a plurality of actuatable valves to control the flow of fluids through the production tree.

Conventionally, wells in oil and gas fields are built up by establishing a wellhead housing, and with a drilling blow out preventer stack (BOP) installed, drilling down to produce the well hole while successively installing concentric casing strings, which are cemented at the lower ends and sealed with mechanical seal assemblies at their upper ends. In order to convert the cased well for production, a tubing string is run in through the BOP and a hanger at its upper end landed in the wellhead. Thereafter the drilling BOP stack is removed and replaced by a Christmas tree having one or more production bores containing actuatable valves and extending vertically to respective lateral production fluid outlet ports in the wall of the Christmas tree.

Such an arrangement introduces many problems which have, previously, been accepted as inevitable. For example, any operations down hole have been limited to tooling which can pass through the production bore, which is usually no more than five inch diameter, unless the Christmas tree is first removed and replaced by a BOP stack. However this involves setting plugs or valves, which may be unreliable by not having been used for a long time, down hole. The well is in a vulnerable condition while the Christmas tree and BOP stack are being exchanged and neither one is in position, which is a lengthy operation. Also, if it is necessary to pull the completion, consisting essentially of the tubing string on its hanger, the Christmas tree must first be removed and replaced by a BOP stack. This usually involves plugging and/or killing the well.

Achieving proper alignment among the various components of a completion system for a subsea well can be a very difficult and time-consuming task. The various components of a subsea completion system, e.g., wellhead, Christmas tree, tubing hanger, etc., are arranged in a stacked configuration wherein each of the various components must be oriented relative to one another or to a fixed reference point, e.g., the wellhead or a guide base. Such orientation is required to insure that the various components properly interface with one another, and to insure that the production outflow line is properly directed toward another subsea component, e.g., a manifold, located on the sea floor. More specifically, proper angular alignment is required to insure that various fluid flow bores and electrical and/or hydraulic lines properly interface with one another when the various components and emergency disconnect devices are stacked up. A very high degree of accuracy, e.g., ±2 degrees, is required in orienting the various components to one another and relative to other subsea components. Such precise alignment is necessary if proper connections are to be made without damage as the devices are lowered into engagement with one another.

This orientation problem is exacerbated in the case of subsea wells as the various devices which are to be stacked up are run down onto guide posts or a guide funnel projecting upwardly from a guide base. The post receptacles which ride down on to the guide posts or the entry guide into the funnel do so with appreciable clearance. This clearance inevitably introduces some uncertainty in alignment and the aggregate misalignment when multiple devices are stacked, can be unacceptably large. Also the exact orientation will depend upon the precise positions of the posts or keys on a particular guide base and the guides on a particular running tool or BOP stack and these will vary significantly from one to another. Consequently it is preferable to ensure that the same running tools or BOP stack are used for the same wellhead, or a new tool or stack may have to be specially modified for a particular wellhead. Further misalignments can arise from the manner in which the guide base is bolted to the conductor casing of the wellhead. As is clear from the foregoing, achieving proper orientation of the various components that comprise a subsea production system can be a very difficult, expensive and time-consuming task.

The present invention is directed to an apparatus and methods for solving, or at least reducing the effects of, some or all of the aforementioned problems.

SUMMARY OF THE INVENTION

The present invention is directed to various embodiments of a subsea system. In one illustrative embodiment, the system is adapted to be coupled to a subsea wellhead and comprises a tubing hanger adapted to be positioned in the wellhead, the tubing hanger comprising a flow opening extending therethrough and at least one eccentrically located opening extending through the tubing hanger, the tubing hanger adapted to be not precisely oriented with respect to a fixed reference point when positioned in the wellhead, and a production tree adapted to be operatively coupled to the tubing hanger, wherein the production tree is oriented relative to the tubing hanger.

In another illustrative embodiment, the system is adapted to be coupled to a subsea wellhead and comprises a tubing hanger adapted to be positioned in the wellhead, the tubing hanger comprising a flow opening extending therethrough and at least one eccentrically located opening extending through the tubing hanger, the tubing hanger adapted to be non-oriented with respect to a fixed reference point when positioned in the wellhead, and a production tree adapted to be operatively coupled to the tubing hanger, wherein the production tree is oriented relative to the tubing hanger.

In yet another illustrative embodiment, the system is adapted to be coupled to a subsea wellhead and comprises a tubing hanger adapted to be positioned in the wellhead, the tubing hanger comprising a centrally located flow opening extending therethrough and at least one eccentrically located opening extending through the tubing hanger, the tubing hanger being adapted to be not precisely oriented with respect to the wellhead when positioned therein, and a production tree comprising a flow bore extending therethrough and a top outlet, the production tree adapted to be operatively coupled to the tubing hanger, wherein the production tree is oriented relative to the tubing hanger and wherein the flow bore in the production tree is in fluid communication with the flow opening in the tubing hanger.

In a further illustrative embodiment, the system is adapted to be coupled to a subsea wellhead and comprises a tubing hanger adapted to be positioned in the wellhead, the tubing hanger comprising a centrally located flow opening extending therethrough and at least one eccentrically located opening extending through the tubing hanger, the tubing hanger being adapted to be non-oriented with respect to the wellhead when positioned therein, and a production tree comprising a flow bore extending therethrough and a top outlet, the production tree adapted to be operatively coupled to the tubing hanger, wherein the production tree is oriented relative to the tubing hanger and wherein the flow bore in the production tree is in fluid communication with the flow opening in said tubing hanger.

BRIEF DESCRIPTION OF THE DRAWINGS

The invention may be understood by reference to the following description taken in conjunction with the accompanying drawings, in which like reference numerals identify like elements, and in which.

Figure 1:
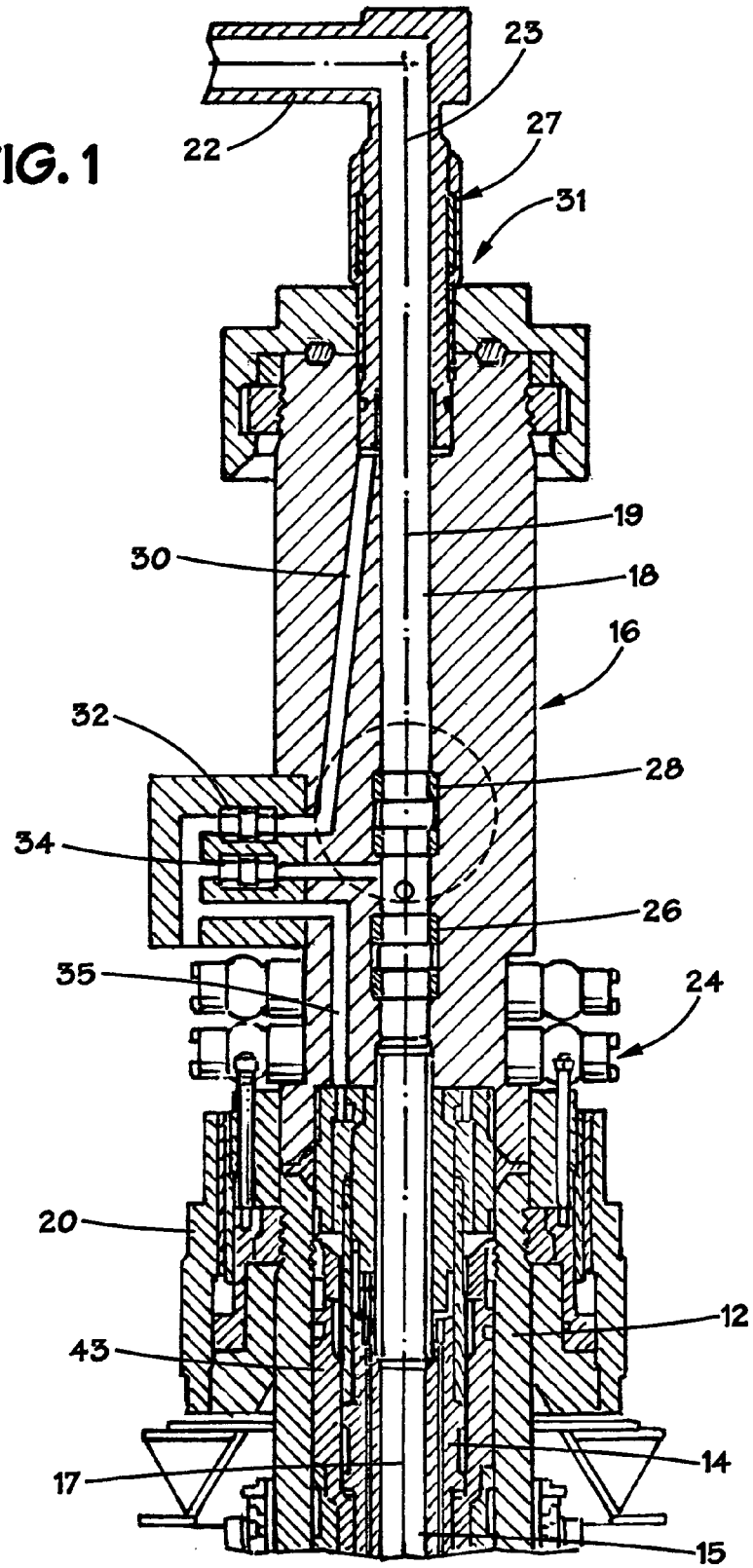
FIG. 1 shows a cross-sectional view of one illustrative embodiment of a subsea completion system in accordance with one aspect of the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present invention will now be described with reference to the attached figures. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

FIG. 1 depicts an illustrative subsea completion system 10 in accordance with one illustrative embodiment of the present invention. As shown therein, in one illustrative embodiment, the present invention comprises a conventional or vertical subsea production tree (Christmas tree) 16 landed above a subsea wellhead 12. The tree 16 may be connected to the wellhead 12 via a hydraulic subsea connector 20 or any other suitable connection means. The tree 16 comprises a flow bore 18 that is adapted to allow for the production of oil and/or gas products from the well or provide a flow path for injection of fluids or gases into the well. The flow bore 18 defines a top outlet 31. In one particularly illustrative embodiment, the flow bore 18 is a vertical flow bore 18, having a centerline 19, that defines the top outlet 31. The tree 16 further comprises one or more valves, such as a production master valve (PMV) 26 and/or production wing valve (PWV) 28, for controlling flow through the flow bore 18. The tree 16 may also include an annulus passageway 30, an annulus swab valve (ASV) 32 for controlling flow through the annulus passageway 30, and a crossover valve (XOV) 34 for controlling flow through a crossover passageway 35 connecting the annulus passageway 30 and the well annulus. One or more chemical injection lines 24 may also be provided, as is well known in the art. The tree 16 depicted in FIG. 1 is illustrative of one type of production tree 16 that may be employed with the present invention. As will be recognized by those skilled in the art after a complete reading of the present application, the tree 16 may take other forms or have other features. For example, the tree 16 may have a non-vertical, e.g., horizontal, flow bore and outlet instead of the vertical flow bore 18 and top outlet 31 depicted in FIG. 1. Thus, the present invention should not be considered as limited to the illustrative configuration of the tree 16 depicted in the attached drawings.

Figure 2A:
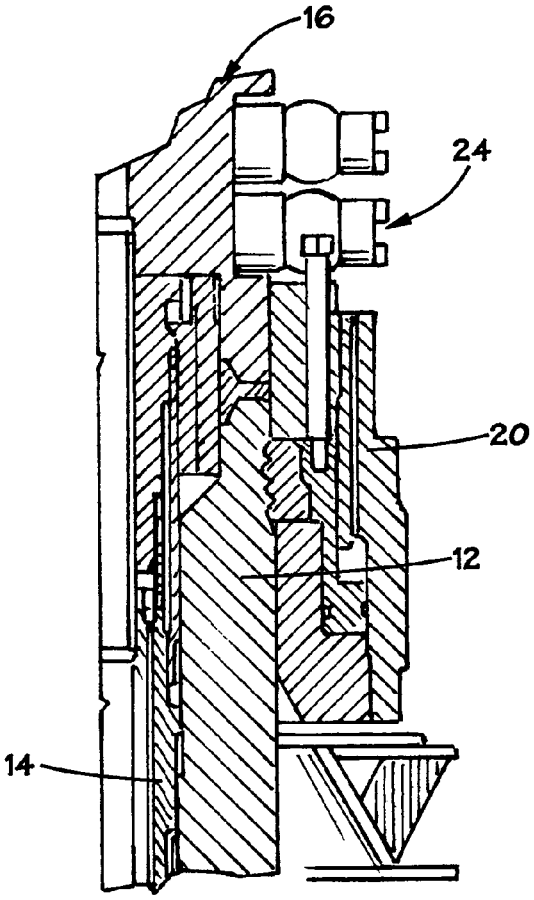
FIG. 2A is an enlarged cross-sectional view of a portion of the present invention.

A tubing hanger 14 is employed to suspend production tubing 15 within the well. The tubing hanger 14 is positioned within the wellhead 12 below the tree 16. The tubing hanger 14 may be landed or positioned within the wellhead 12 using a variety of known techniques. For example, the tubing hanger 14 may directly contact the wellhead 12 or may be landed in a previously installed lockdown bushing 43 (shown on the left side of FIG. 1). FIG. 2A is an enlarged partial view of the system 10 wherein the tubing hanger 14 is positioned within the wellhead 12 without use of the bushing 43. In one embodiment, the tubing hanger 14 has a centerline 17.

Figure 2C:
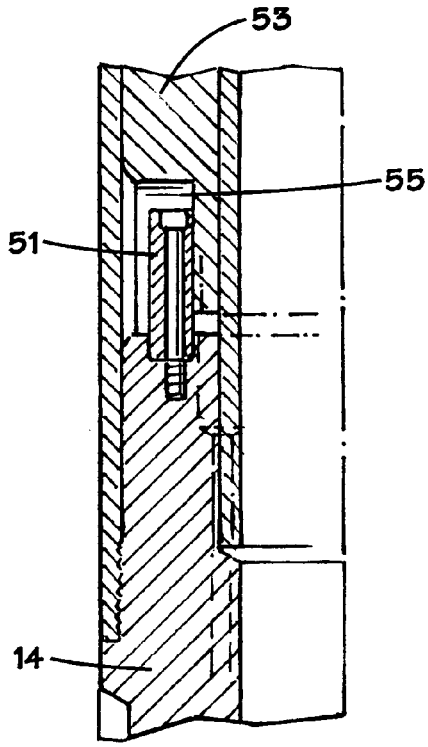
FIG. 2C depicts an illustrative coarse, non-precise orientation system wherein the tubing hanger may be non-precisely oriented with respect to a fixed reference point.
Figure 2B:
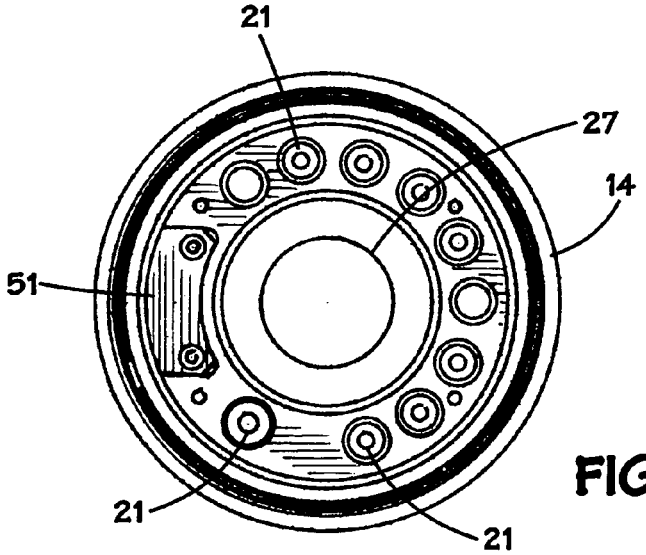
FIG. 2B is a top view of a tubing hanger that may be employed with one illustrative embodiment of the present invention.

FIG. 2B is a cross-sectional, plan view of a portion of an illustrative tubing hanger 14 that may be employed with various embodiments of the present invention. As shown therein, in one illustrative embodiment, the tubing hanger 14 comprises a flow opening 27 and a plurality of eccentrically located openings 21, one or more of which extend through the tubing hanger 14. In one particular embodiment, the flow opening 27 is centrally located within the tubing hanger 14. The size, number and location of the openings 21 may vary depending on the particular application. For example, one of the openings 21 may provide access to the well annulus, while other openings or penetrations 21 may be employed for various chemical, hydraulic, electrical and/or optical lines. Metal-to-metal seals (not shown) may be provided to seal various penetrations that extend into or through the tubing hanger 14. Thus, the number, size, location and purpose of each of the openings 21 should not be considered a limitation of the present invention. In one particularly illustrative embodiment, the tubing hanger 14 may comprise eight of such eccentrically located openings 21. In another very illustrative example of the present invention, the top outlet 31, the flow bore 18 in the tree 16, and the flow opening 27 in the tubing hanger 14 may all be axially aligned with one another. In other embodiments, only the top outlet 31 may be coaxially aligned with the centerline of the wellhead 12.

For reasons described in more detail below, in one illustrative embodiment, the tubing hanger 14 is adapted to be positioned or landed within the wellhead 12 such that it is coarsely or non-precisely oriented relative to a fixed reference point, e.g., the wellhead 12, a guide base (not shown), a drilling template (not shown), etc. In stating that the tubing hanger 14 may be positioned within the wellhead 12 in a non-precisely oriented fashion, it is meant that the tubing hanger 14 is not oriented in the sense of providing precise orientation between the tubing hanger 14 and the wellhead 12, as is the case with prior art systems wherein the tubing hanger 14 was oriented to the wellhead 12 (or other fixed point of reference) with great precision, e.g., ±2 degrees using various mechanical means, such as pin/slot configurations. That is, in this embodiment, the maximum orientational accuracy that may be achieved for the non-precisely oriented tubing hanger 14 relative to a fixed reference point, e.g., the wellhead 12, is ±5 degrees. In other embodiments, such a non-precise orientation means may have a maximum accuracy of ±10 degrees or more, depending on the application. Such non-precise orientation may be accomplished by, in one embodiment, various mechanical mechanisms known to those skilled in the art, e.g., pin/slot arrangements, pin/helix arrangements, etc. However, such mechanical means would not provide any higher degree of orientation tolerance than ±5 degrees. Such a non-precise orientation system would be ineffective in providing the precise mechanical orientation required of prior art systems, wherein the tubing hanger 14 is precisely oriented, e.g., within ±2 degrees, relative to the wellhead 12, or other fixed reference point.

In another illustrative embodiment, the tubing hanger 14 is adapted to be positioned in the wellhead 12 such that it is not oriented with respect to any fixed reference point, e.g., the wellhead 12, guide base, etc., by any mechanical means. That is, in this illustrative embodiment, the tubing hanger 14 may be positioned in the wellhead without reference to any fixed reference point, i.e., the orientation of the tubing hanger 14 is independent with respect to the wellhead 12. In this embodiment, by "non-oriented" it is meant that there is no mechanical orientation means, e.g., pin/slot, pin/helix, etc., employed to orient the tubing hanger 14 relative to a fixed subsea reference point, such as the wellhead 12 or a guide base.

The production tree 16 is adapted to be operatively coupled to and precisely oriented relative to the tubing hanger 14. Once coupled together, the flow bore 18 of the tree 16 is in fluid communication with the flow opening 27 in the tubing hanger 14. In one particular embodiment, the flow bore in the tree 16 and the flow opening in the tubing hanger 14 are coaxially aligned. The top outlet 31 may also be coaxially aligned with respect to the center-line of the wellhead 12. The orientation between the tubing hanger 14 and the tree 16 is very precise, e.g., ±2 degrees, due to the interfacing lines, stabs, projections and openings on the tree 16 and tubing hanger 14 that operatively engage one another. The precise orientation between the tree 16 and the tubing hanger 14 may be accomplished by a variety of known mechanical techniques. For example, FIG. 2C depicts one illustrative embodiment wherein an orientation key 51 may be provided on the tubing hanger 14, and a downwardly extending bushing 53 having an orientation slot 55 is provided on the bottom of the tree 16. When the tree 16 engages the tubing hanger 14, e.g., when the tree 16 is landed on the wellhead 12, the orientation slot 55 on the bushing 53 engages the orientation key 51 on the tubing hanger 14, and orients the tree 16 relative to the tubing hanger 14. In other embodiments, the tree 16 may be oriented to the tubing hanger 14 using any other suitable orientation means.

In still other embodiments of the present invention, the tubing hanger 14 may be coarsely oriented, or non-precisely oriented, relative to the wellhead 12 using any suitable orientation means, and the tree 16 may be precisely oriented relative to the tubing hanger 14 using any suitable orientation means. For example, in accordance with one aspect of the present invention, precise orientation between the tubing hanger 14 and a fixed reference point, e.g., the wellhead 12 or guide base, is not required. That is, the precision orientation between the tubing hanger 14 and the tree 16 may be established without regard to the orientation between the tubing hanger 14 and a fixed reference point, e.g., the wellhead 12. Nevertheless, in some applications, it may be desirable to provide coarse, non-precise orientation capability between the tubing hanger 14 and a fixed reference point, e.g., the wellhead 12 or a guide base. For example, it may be desirable to orient the body of the tree 16 (which is relatively large) in a desired general direction such that the body of the tree 16 does not interfere with other structures that have previously been installed or will be installed at a later time. Such coarse, non-precise orientation is not provided for purposes of aligning various production outlets, stabs and openings where very high precision, e.g., ±2 degrees, is required in the orientation process. Such a coarse, non-precise orientation system would not be capable of providing such a high degree of orientation accuracy. For example, such a coarse, non-precise orientation system would not provide an orientation accuracy greater than ±5 degrees. The coarse, non-precise orientation between the tubing hanger 14 and the fixed reference point, e.g., wellhead 12, may be provided by any of a variety of known mechanical techniques, e.g., a key/slot arrangement, a pin/helix arrangement, a key/helix arrangement, etc. Such coarse, non-precise orientation may also be provided by non-mechanical means, such as a GPS-based system or the like.

A flowline jumper 22, having a centerline 23, is connected to the top outlet 31 of the flow bore 18 of the tree 16 via a flowline jumper connector 27, which, in one embodiment, engages the flow bore 18 along the centerline 19 of the tree 16. The flowline jumper connector 27 may comprise a swivel joint. The flowline jumper 22 may be of any desired structure and may be any desired configuration. For example, the flowline jumper 22 may be fabricated from rigid pipe or flexible conduit, it may be constructed with articulated joints, it may be buoyant or partially buoyant, and it may terminate in a horizontal or vertical connection. As described more fully below, the flowline jumper 22 may extend laterally to another subsea component 40, e.g., a sled, a manifold, a flowline connector, or other component disposed at some distance from the subsea completion system 10. Alternatively, the flowline jumper 22 may extend to a separate production facility (not shown) located on a surface vessel or platform or a land-based production facility.

Figure 3A:
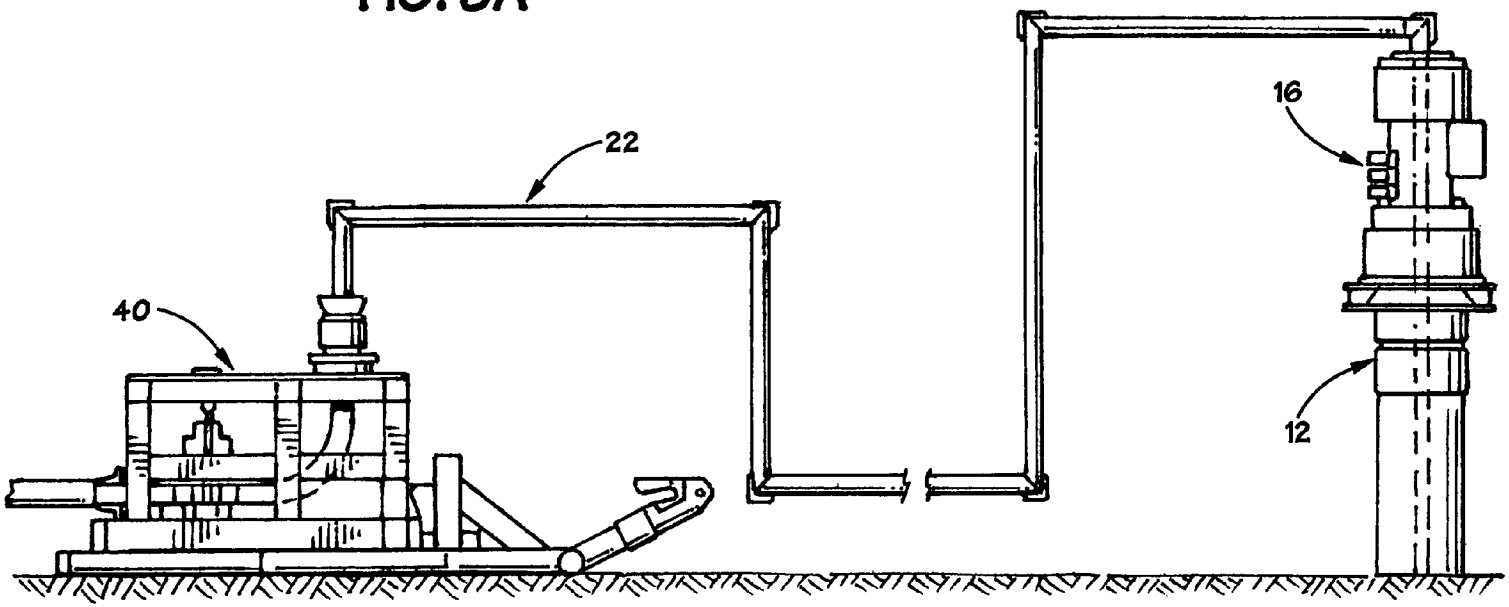
FIGS. 3A-3B depict various illustrative embodiments of a subsea completion system employing various aspects of the present invention.
Figure 3B:
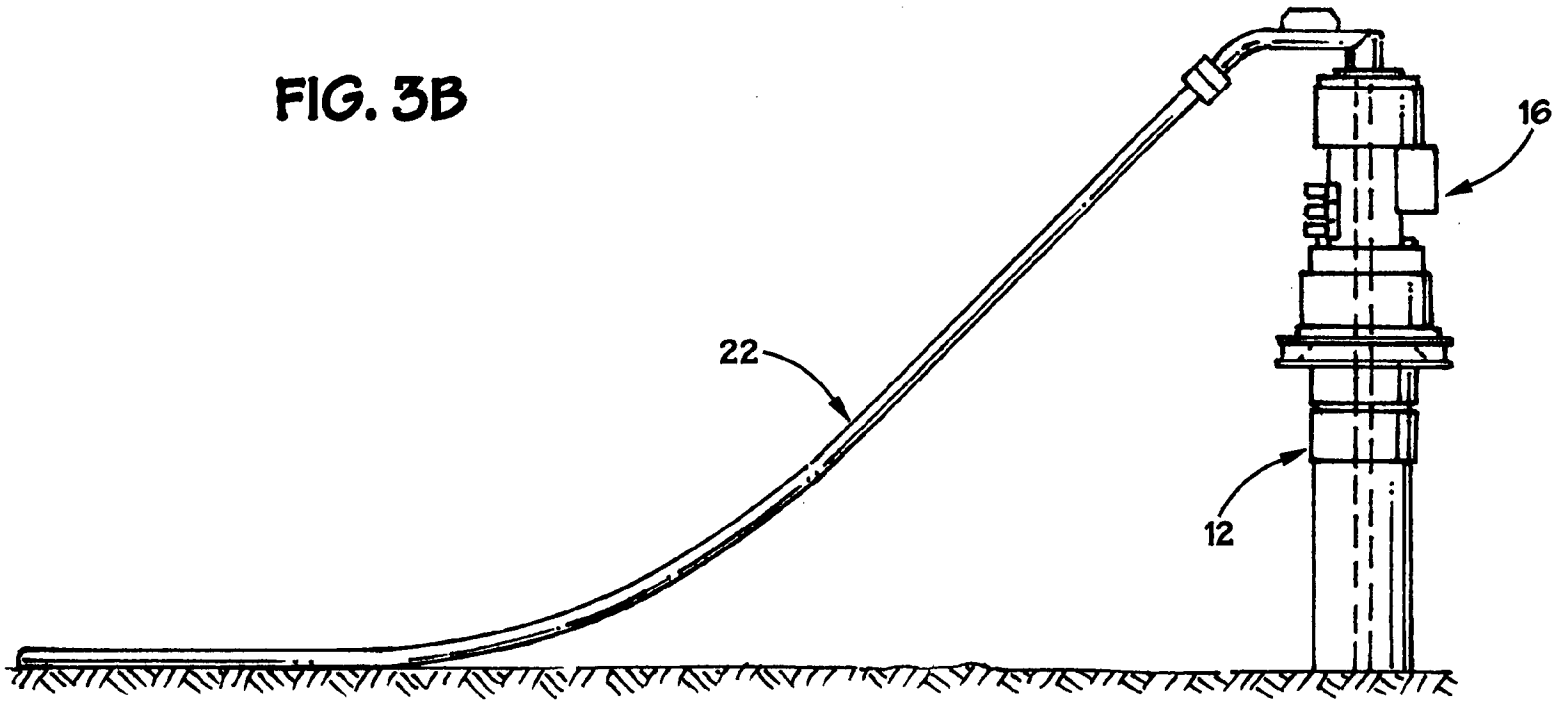

FIGS. 3A-3B depict various illustrative embodiments of a subsea system 10 in accordance with various aspects of the present invention. In general, in various embodiments, the flowline jumper 22 may be operatively coupled to any of a variety of different subsea components 40. The illustratively depicted component 40 may be any of a variety of known subsea components employed in producing oil or gas from subsea wells, or injecting fluids or gases into such wells. For example, the subsea component 40 may be a sled, a manifold, a flowline connector, a subsea processing facility, a subsea separator, a pump unit, etc. In the embodiment depicted in FIG. 3A, the subsea component 40 is a sled. FIG. 3B depicts an alternative embodiment wherein the flowline jumper 22 is comprised of a flexible conduit that is adapted to be coupled to a production facility (not shown) that may be either land-based or located on a surface vessel or platform. If desired, such a flexible subsea jumper 22 may also be employed when a subsea component 40, e.g., a manifold, is employed as part of the system 10.

In other cases, the tubing hanger 14 may be run to the sea floor and positioned in the wellhead 12. Thereafter, the tree 16 may be operatively coupled to the previously installed tubing hanger 14 wherein precise orientation alignment is achieved between the tubing hanger 14 and the tree 16.

In the illustrative embodiment depicted in FIG. 1, the tree 16 comprises a vertical flow bore 18 and a top outlet 31. Because production flow occurs through the top outlet 31 of the tree 16 along the centerline 19, there is no wing outlet on the tree 16. This allows the system 10 to be simplified in several ways. First, elimination of the wing outlet reduces the number of valves required, thus reducing the size, weight, and complexity of the tree 16. Second, because the flowline jumper connection 27 is along the tree centerline 19, there is no longer a need to orient the tree 16 relative to the wellhead 12, or other fixed reference point, because it is not necessary to "point" the production outlet in any particular direction. In previous systems employing a horizontal production outlet, a Christmas tree had to be oriented relative to a known reference (i.e. the wellhead). Because the tubing hanger was run prior to the tree, the tubing hanger also had to be oriented relative to a known reference (i.e. the wellhead), in order to ensure that the tubing hanger was aligned with the tree. With some embodiments of the present invention, it is only necessary to orient the tree 16 to the tubing hanger 14, regardless of the orientation of either component relative to the wellhead 12. Not only does this reduce the complexity of the tree 16 and the tubing hanger 14, it also greatly simplifies the installation procedure, because only the tree 16 must be precisely oriented during running, instead of precisely orienting both the tree 16 and the tubing hanger 14. This creates significant savings for the operator. Third, the centerline location of the flowline jumper connection 27 allows jumper measurements to be made much earlier in the installation process. For example, the measurements could be taken from the wellhead 12, with the future height of the tree 16 calculated in. This allows more time for jumper 22 fabrication, and thereby reduces the cost and the risk of delay associated with the jumpers 22. Another advantage of the concentric connection is that the tree 16 and tubing hanger 14 may be removed and re-installed in a different orientation without affecting the design of the jumper 22.

Figure 4:
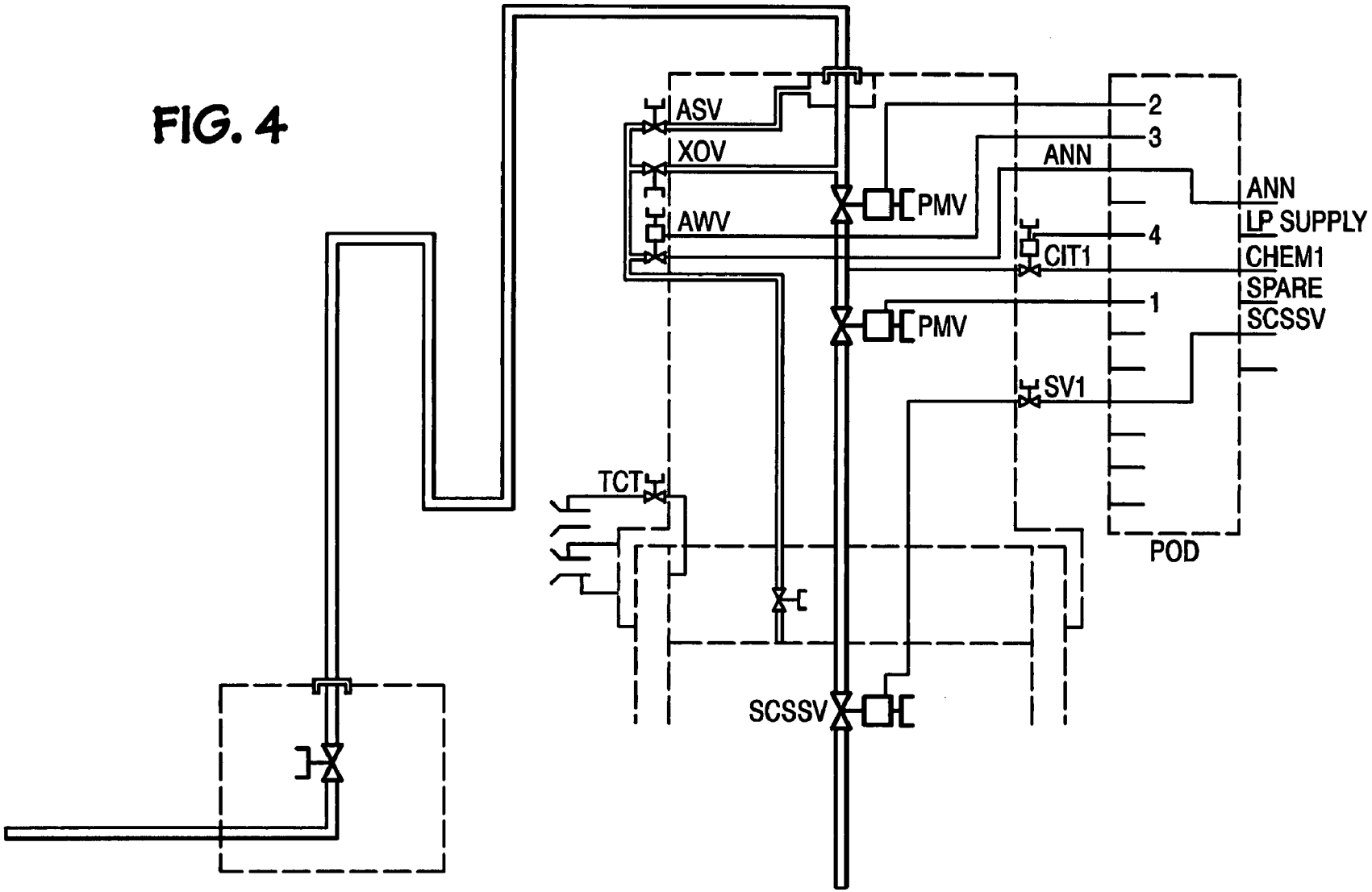
FIG. 4 shows a controls schematic for a low-function embodiment.
Figure 5:
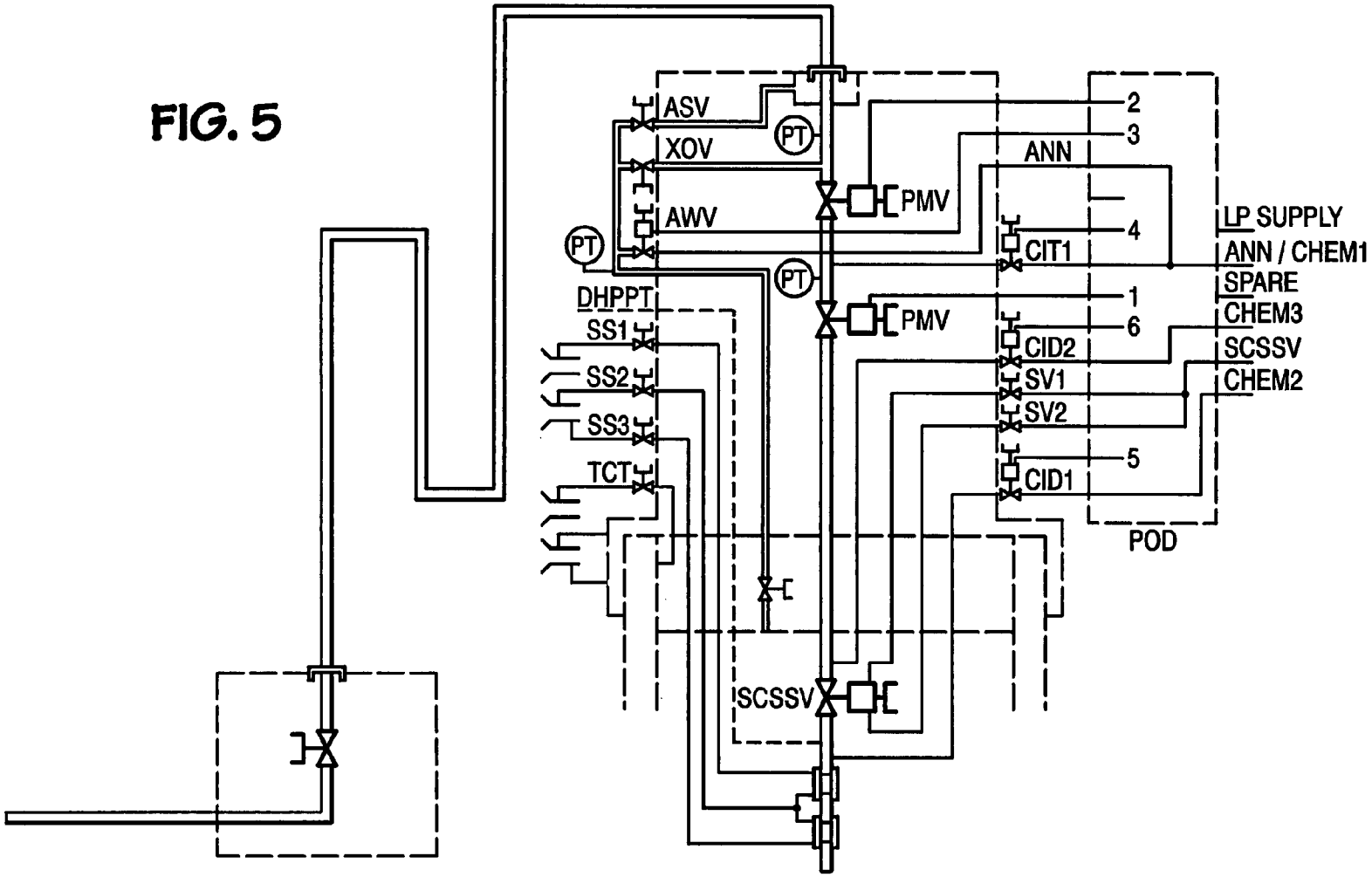
FIG. 5 shows a controls schematic for a medium-function embodiment.
Figure 6:
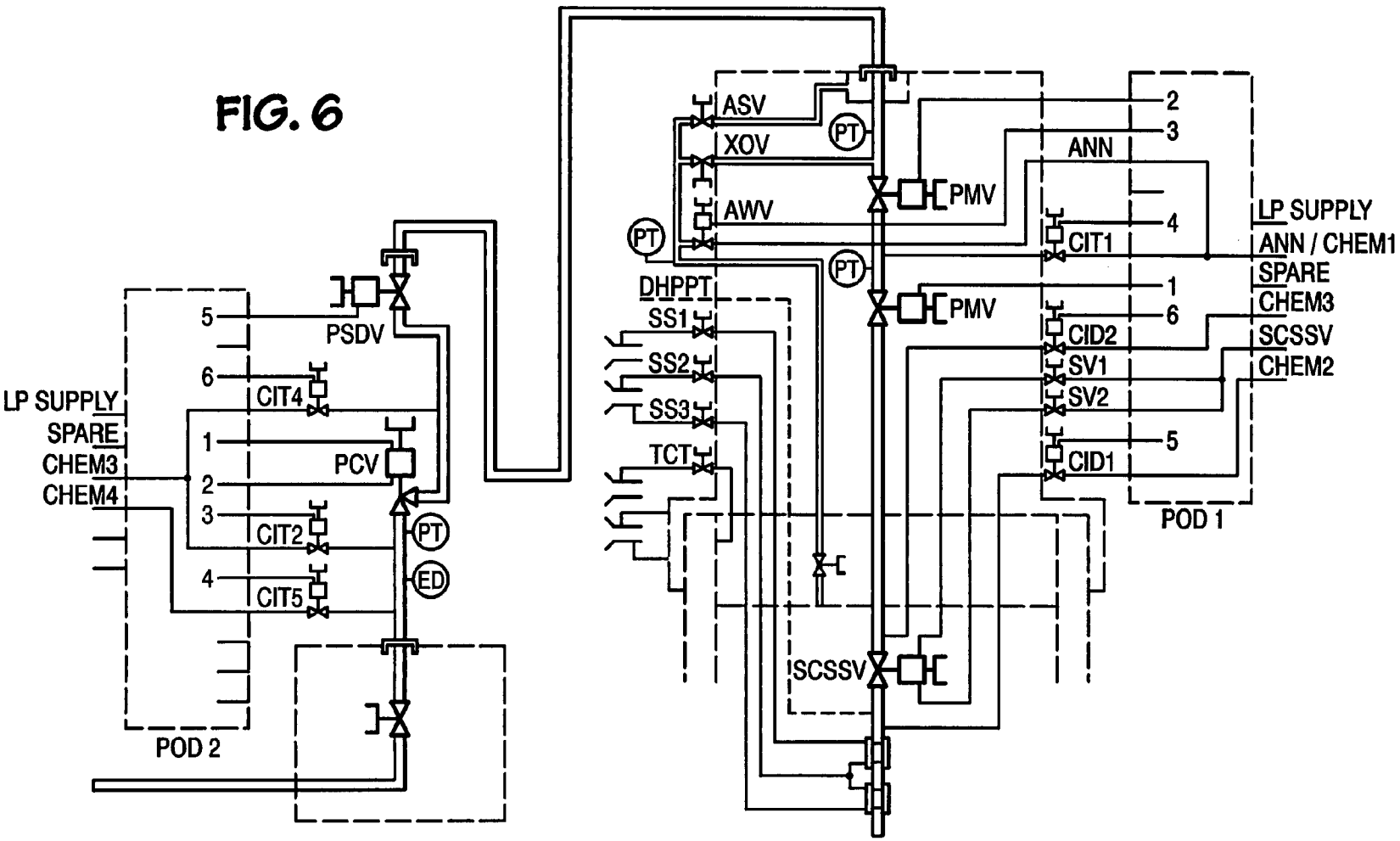
FIG. 6 shows a controls schematic for a high-function embodiment.

FIGS. 4, 5 and 6 are control schematics of various embodiments of the present invention that involve increasing degrees of complexity and functionality for the system disclosed herein. Referring to FIG. 4, a relatively low-function, low-cost embodiment of the invention is shown schematically. In this embodiment, a control pod may be used to control the production wing valve (PWV) 28, the production master valve (PMV) 26, the surface controlled subsurface safety valve (SCSSV), the annulus wiring valve (AWV), and a chemical injection valve. The annulus swab valve (ASV) 32 and the crossover valve (XOV) 34 may be operable by a remotely operated vehicle (ROV). Control of the subsea connector may be provided via ROV hot stabs, in accordance with well known techniques.

Referring to FIG. 5, a medium-function, medium-cost embodiment of the invention is shown schematically. In this embodiment, a control pod may be used to control the same components as the previous embodiment, as well as an additional chemical line, and an additional control line for the SCSSV. Additional ROV hot stabs may be provided for controlling one or more downhole sliding sleeve valves.

Referring to FIG. 6, a relatively high-function embodiment of the invention is shown schematically. In this embodiment, a first control pod (POD 1) may be used to control the same components as the previous embodiment, and the same hot stab controls may be provided as in the previous embodiment. A choke module may be provided between the flowline jumper 22 and the subsea component 40, e.g., the sled/manifold/connector/hub. The choke module may include an additional production valve (PSDV), a production choke (PCV) and one or more chemical lines. A second control pod (POD 2) may be used to control the components of the choke module.

In one embodiment, the present invention comprises a conventional or vertical subsea Christmas tree 16 landed above a subsea wellhead 12. A tubing hanger 14 is landed within the wellhead 12 below the Christmas tree 16. The Christmas tree 16 includes a concentric vertical flow bore 18 and one or more production bore valves for controlling flow therethrough. A flowline jumper 22 is connected to the top of the flow bore 18 via a flowline jumper connector, which engages the flow bore 18 along the centerline of the tree 16. The flowline jumper 22 may extend laterally to a sled, manifold, flowline connector, or other component disposed at some distance from the subsea completion system. Alternatively, the flowline jumper 22 may extend to a separate production hub mounted on the subsea completion system.

The particular embodiments disclosed above are illustrative only, as the invention may be modified and practiced in different but equivalent manners apparent to those skilled in the art having the benefit of the teachings herein. For example, the process steps set forth above may be performed in a different order. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. A system adapted to be coupled to a subsea wellhead, comprising:

a tubing hanger adapted to be positioned in said wellhead, said tubing hanger comprising a flow opening extending therethrough and at least one eccentrically located opening extending through said tubing hanger, said tubing hanger adapted to be not precisely oriented with respect to a fixed reference point when positioned in said wellhead;

a production tree comprising at least one valve and a top outlet that is coaxially aligned with said wellhead, said production tree adapted to be operatively coupled to said tubing hanger, wherein said production tree is angularly oriented relative to said tubing hanger; and a subsea jumper conduit adapted to be operatively coupled to said top outlet of said tree and to an inlet of a subsea component.

2. The system of claim 1, wherein said tubing hanger is not oriented with respect to said fixed reference point.

3. The system of claim 1, wherein said fixed reference point comprises said subsea wellhead.

4. The system of claim 1, wherein said flow opening in said tubing hanger is centrally located in said tubing hanger.

5. The system of claim 1, wherein said flow opening in said tubing hanger is centrally located in said tubing hanger, a flow bore of said tree is a vertical flow bore, and said vertical flow bore of said tree is concentrically oriented with respect to said centrally located flow opening in said tubing hanger.

6. The system of claim 1, wherein said component comprises at least one of a manifold, a sled, a flow line connector, a subsea processing unit and a pump unit.

7. The system of claim 1, wherein said at least one eccentric opening comprises at least one of an annulus flow opening, an opening for an electrical component, and an opening for a hydraulic connection.

8. The system of claim 1, wherein said production tree comprises at least one non-vertical production outlet.

9. A system adapted to be coupled to a subsea wellhead, comprising:

a tubing hanger adapted to be positioned in said wellhead, said tubing hanger comprising a flow opening extending therethrough and at least one eccentrically located opening extending through said tubing hanger, said tubing hanger adapted to be non-oriented with respect to a fixed reference point when positioned in said wellhead;

a production tree comprising at least one valve and a top outlet that is coaxially aligned with said wellhead, said production tree adapted to be operatively coupled to said tubing hanger, wherein said production tree is angularly oriented relative to said tubing hanger; and a subsea jumper conduit adapted to be operatively coupled to said top outlet of said tree and to an inlet of a subsea component.

10. The system of claim 9, wherein said fixed reference point comprises said wellhead.

11. The system of claim 9, wherein said flow opening in said tubing hanger is centrally located in said tubing hanger.

12. The system of claim 9, wherein said flow opening in said tubing hanger is centrally located in said tubing hanger, said flow bore of said tree is a vertical flow bore, and said vertical flow bore of said tree is concentrically oriented with respect to said centrally located flow opening in said tubing hanger.

13. The system of claim 9, wherein said production tree comprises at least one non-vertical production outlet.

14. A system adapted to be coupled to a subsea wellhead, comprising:

a tubing hanger adapted to be positioned in said wellhead, said tubing hanger comprising a centrally located flow opening extending therethrough and at least one eccentrically located opening extending through said tubing hanger, said tubing hanger being adapted to be not precisely oriented with respect to said wellhead when positioned therein;

a production tree comprising at least one valve, a flow bore extending therethrough and a top outlet that is coaxially aligned with said wellhead, said production tree adapted to be operatively coupled to said tubing hanger, wherein said production tree is angularly oriented relative to said tubing hanger and wherein said flow bore in said production tree is in fluid communication with said flow opening in said tubing hanger; and a subsea jumper conduit adapted to be operatively coupled to said top outlet of said tree and to an inlet of a subsea component.

15. The system of claim 14, wherein said flow bore in said tree is a vertical flow bore.

16. The system of claim 15, wherein said vertical flow bore of said tree is coaxially oriented with respect to said centrally located flow opening in said tubing hanger.

17. The system of claim 15, wherein said flow opening in said tubing hanger is centrally located in said tubing hanger, and said vertical flow bore of said tree is concentrically oriented with respect to said centrally located flow opening in said tubing hanger.

18. A system adapted to be coupled to a subsea wellhead, comprising:

a tubing hanger adapted to be positioned in said wellhead, said tubing hanger comprising a centrally located flow opening extending therethrough and at least one eccentrically located opening extending through said tubing hanger, said tubing hanger being adapted to be non-oriented with respect to said wellhead when positioned therein; and a production tree comprising at least one valve, a flow bore extending therethrough and a top outlet that is coaxially aligned with said wellhead, said production tree adapted to be operatively coupled to said tubing hanger, wherein said production tree is angularly oriented relative to said tubing hanger and wherein said flow bore in said production tree is in fluid communication with said flow opening in said tubing hanger; and a subsea jumper conduit adapted to be operatively coupled to said top outlet of said tree and to an inlet of a subsea component.

19. The system of claim 18, wherein said flow bore in said tree is a vertical flow bore.

20. The system of claim 18, wherein said vertical flow bore of said tree is coaxially oriented with respect to said centrally located flow opening in said tubing hanger.

21. The system of claim 19, wherein said flow opening in said tubing hanger is centrally located in said tubing hanger, and said vertical flow bore of said tree is concentrically oriented with respect to said centrally located flow opening in said tubing hanger.

* * * * *

UNITED STATES PATENT AND TRADEMARK OFFICE

CERTIFICATE OF CORRECTION

PATENT NO. : 7,296,629 B2
APPLICATION NO. : 10/965135
DATED : November 20, 2007
INVENTOR(S) : Christopher D. Bartlett It is certified that error appears in the above-identified patent and that said Letters Patent is hereby corrected as shown below:

Col. 11, line 1 (claim 20, line 1), change "claim 18" to -- claim 19 --.

Signed and Sealed this

Eleventh Day of March, 2008

JON W. DUDAS
*Director of the United States Patent and Trademark Office*